US011142976B2

(12) United States Patent
Al-Mousa et al.

(10) Patent No.: US 11,142,976 B2
(45) Date of Patent: Oct. 12, 2021

(54) POSITIONING DOWNHOLE-TYPE TOOLS

(71) Applicant: Saudi Arabian Oil Company, Dhahran (SA)

(72) Inventors: Ahmed Al-Mousa, Dhahran (SA); Marius Neacsu, Dhahran (SA); Ahmed A. Al-Ramadhan, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 212 days.

(21) Appl. No.: 16/273,864

(22) Filed: Feb. 12, 2019

(65) Prior Publication Data

US 2020/0256143 A1 Aug. 13, 2020

(51) Int. Cl.

| | |
|---|---|
| ***E21B 23/03*** | (2006.01) |
| ***E21B 33/12*** | (2006.01) |
| *E21B 31/00* | (2006.01) |
| *E21B 23/01* | (2006.01) |
| *E21B 23/10* | (2006.01) |

(52) U.S. Cl.

CPC ..... *E21B 23/03* (2013.01); *E21B 33/12* (2013.01); *E21B 23/01* (2013.01); *E21B 23/10* (2013.01); *E21B 31/00* (2013.01)

(58) Field of Classification Search

CPC ..... E21B 23/03; E21B 23/08; E21B 23/10; E21B 33/12

See application file for complete search history.

(56) References Cited

U.S. PATENT DOCUMENTS

| | | | | |
|---|---|---|---|---|
| 1,949,498 | A | 3/1934 | Frederick et al. | |
| 4,190,112 | A | 2/1980 | Davis | |
| 4,227,573 | A | 10/1980 | Pearce et al. | |
| 4,407,367 | A | 10/1983 | Kydd | |
| 5,678,635 | A | 10/1997 | Dunlap et al. | |
| 6,138,764 | A * | 10/2000 | Scarsdale | E21B 23/08 166/117.6 |
| 9,133,671 | B2 | 9/2015 | Kellner | |
| 2007/0181304 | A1 | 8/2007 | Rankin et al. | |
| 2010/0263856 | A1 | 10/2010 | Lynde et al. | |
| 2014/0158350 | A1 | 6/2014 | Castillo et al. | |
| 2016/0305215 | A1 | 10/2016 | Harris et al. | |
| 2016/0340994 | A1* | 11/2016 | Ferguson | E21B 23/14 |
| 2017/0089166 | A1 | 3/2017 | Sullivan | |
| 2019/0186232 | A1* | 6/2019 | Ingram | E21B 33/128 |
| 2019/0203551 | A1* | 7/2019 | Davis | E21B 23/08 |

FOREIGN PATENT DOCUMENTS

| | | |
|---|---|---|
| GB | 958734 | 5/1964 |

OTHER PUBLICATIONS

PCT International Search Report and Written Opinion in International Appln. No. PCT/US2020/017550, dated Jun. 2, 2020, 14 pages.

* cited by examiner

*Primary Examiner* — Robert E Fuller
*Assistant Examiner* — Lamia Quaim
(74) *Attorney, Agent, or Firm* — Fish & Richardson P.C.

(57) ABSTRACT

One downhole-type tool of a set of interchangeable downhole-type tools is interchangeably received by a pump-down adapter. The downhole-type tool is positioned by the pump-down adapter within a wellbore tubular. The downhole-type tool is released by the pump-down adapter.

12 Claims, 5 Drawing Sheets

POSITIONING DOWNHOLE-TYPE TOOLS

TECHNICAL FIELD

This disclosure relates to installing and removing wellbore-type tools into and out of a wellbore.

BACKGROUND

Wellbores are formed in geologic formations for a variety of reasons, such as for fluid production (hydrocarbon production, water production, etc.) of fluid injection (water injection, gas injection, disposal wells, etc.). Wellbores can be cased or lined with tubulars, or they can be "open-hole" wellbores. In some implementations, separate injection or production tubulars are positioned within wellbores. Such tubulars provide a flow passage for fluids. As wellbores age, wellbore components (such as casing, liners, production tubulars, injection tubulars, etc.) can degrade and need repair or cleaning. A wellbore goes through a "workover" to rectify such concerns. A workover involves sending wellbore tools into the wellbore to correct any issues that have arisen during the life of the wellbore.

SUMMARY

This disclosure describes technologies relating to positioning downhole-type tools.

An example implementation of the subject matter described within this disclosure is a method with the following features. One downhole-type tool of a set of interchangeable downhole-type tools is interchangeably received by a pump-down adapter. The downhole-type tool is positioned by the pump-down adapter within a wellbore tubular. The downhole-type tool is released by the pump-down adapter.

Aspects of the example implementation, which can be combined with the example implementation alone or in part, include the following. The downhole-type tool is seated within the wellbore tubular.

Aspects of the example implementation, which can be combined with the example implementation alone or in part, include the following. The downhole-type tool is seated prior to releasing the downhole-type tool by the pump-down adapter.

Aspects of the example implementation, which can be combined with the example implementation alone or in part, include the following. Seating the downhole-type tool includes extending a packer or hanger from a radial surface of the downhole-type tool by a battery powered extension system within the downhole-type tool.

Aspects of the example implementation, which can be combined with the example implementation alone or in part, include the following. A first portion of the tubular uphole of the one or more fins and a second portion of the tubular downhole of the one or more fins are sealed by one or more fins extending radially from an outer surface of the pump-down adapter.

Aspects of the example implementation, which can be combined with the example implementation alone or in part, include the following. Positioning the downhole-type tool includes pumping fluid into the first portion of the tubular. The pumped fluid increases a pressure in the first portion of the tubular. The increased pressure in the first portion of the tubular moves the pump-down adapter.

Aspects of the example implementation, which can be combined with the example implementation alone or in part, include the following. After releasing the downhole-type tool, the downhole-type tool is received by the pump-down adapter. The downhole-type tool is removed from the wellbore.

Aspects of the example implementation, which can be combined with the example implementation alone or in part, include the following. Removing the downhole-type tool includes pumping fluid into an annulus and up a wellbore tubular. The pumped fluid increases a pressure in the second portion of the tubular.

Aspects of the example implementation, which can be combined with the example implementation alone or in part, include the following. Releasing the downhole-type tool includes over pulling the pump-down adapter by a wireline. A shear pin is sheared in response to the over pulling. The shear pin attaches the pump-down adapter and the downhole-type tool.

Aspects of the example implementation, which can be combined with the example implementation alone or in part, include the following. The pump-down adapter is removed from the wellbore. A second downhole-type tool of the interchangeable downhole-type tools is received by the pump-down adapter. The second downhole-type tool is positioned by the pump-down adapter within a wellbore tubular.

An example implementation of the subject matter described within this disclosure is a pump-down adapter with the following features. A central body includes an uphole end configured to be attached to a wireline. A downhole end is configured to interchangeably receive one of a plurality of downhole-type tools. One or more fins extend radially from an outer surface of the central body. The one or more fins are configured to engage with an inner wall of a downhole tubular.

Aspects of the example implementation, which can be combined with the example implementation alone or in part, include the following. The downhole end includes threads configured to engage with any of the plurality of downhole-type tools.

Aspects of the example implementation, which can be combined with the example implementation alone or in part, include the following. The downhole end includes a cavity defined by an outer surface of the pump-down adapter.

Aspects of the example implementation, which can be combined with the example implementation alone or in part, include the following. The one or more fins are a first fin set. The pump-down adapter further includes a second fin set with one or more rubber fins extending radially from the outer surface of the pump-down adapter. The second fin set is configured to engage with an inner wall of a downhole tubular. The second fin set is axially offset from the first fin set.

An example implementation of the subject matter described within this disclosure is a method with the following features. An interchangeable downhole-type tool of a set of interchangeable downhole-type tools is attached to a pump-down adapter. A first portion of the tubular uphole of the one or more fins, and a second portion of the tubular downhole of the one or more fins, are sealed from one-another, by one or more fins extending radially from an outer surface of the pump-down adapter. The downhole-type tool and the pump-down adapter are positioned within a wellbore tubular. The downhole-type tool is separated from the pump-down adapter.

Aspects of the example implementation, which can be combined with the example implementation alone or in part, include the following. Positioning the downhole-type tool and the pump-down adapter includes pumping fluid into the first portion of the tubular. The pumped fluid increases a pressure in the first portion of the tubular.

Aspects of the example implementation, which can be combined with the example implementation alone or in part, include the following. After separating the downhole-type tool, the downhole-type tool is attached to the pump-down adapter. The downhole-type tool and the pump-down adapter are removed from the wellbore.

Aspects of the example implementation, which can be combined with the example implementation alone or in part, include the following. Removing the downhole-type tool includes pumping fluid into an annulus and up a wellbore tubular. The pumped fluid increases a pressure in the second portion of the tubular.

Aspects of the example implementation, which can be combined with the example implementation alone or in part, include the following. The downhole-type tool further includes a fishing neck. The pump-down adapter includes a fishing tool configured to receive the fishing neck. Attaching the downhole-type tool to the pump-down adapter includes securing the fishing tool to the fishing neck.

Aspects of the example implementation, which can be combined with the example implementation alone or in part, include the following. The downhole-type tool is a tubular puncher. A hole is formed in a tubular wall by the tubular puncher.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Deploying wellbore tools often includes "pushing" the tool in a downhole direction with drill pipe or similarly rigid lengths. Such pushing is used particularly in horizontal or deviated wellbores where gravity is of little use to assist in deployment. Inserting wellbore tools with drill pipe involves a work-over rig, which includes a derrick, drawworks, and other such equipment. Such equipment takes an extensive amount of time and space to set-up prior to a workover job, and requires extensive time to tear-down after a workover job is complete.

This disclosure relates to a pump-down adapter that can be connected to or slipped over a well tool and deployed through a tubing or casing. The tools that can be coupled to the pump-down adapter include, for example, a well intervention tool, retrievable bridge plugs, logging tools, tubular punches, or other tools. The pump-down adapter includes fins that engage with an inner diameter of the tubular through which the adapter and the tool are to be pumped down. A downhole-end of the pump-down adapter can include a threaded connection or a slip-over connection depending on the type of coupling most appropriate for the tool. The pump-down adapter utilizes a pressure differential across the pump-down adapter, caused by bullheading or circulating fluid, to move and position the tool within the tubular. Such a motive force works with vertical, inclined, and horizontal wellbores. In operation, the adapter and the tool are coupled to a slickline (or wireline) and are pumped through the tubing or the casing using circulation fluid, for example, drilling fluid. When the tool reaches the desired location, additional pressure is applied that pushes the plug past the desired depth. At that depth, the plug is set, for example, using a packer. After certain well operations have been performed, the tool can be retrieved using the slickline (or wireline). Such an operation can be performed without a workover rig, saving a substantial amount of time as no rig set-up or teardown is required.

Figure 1:
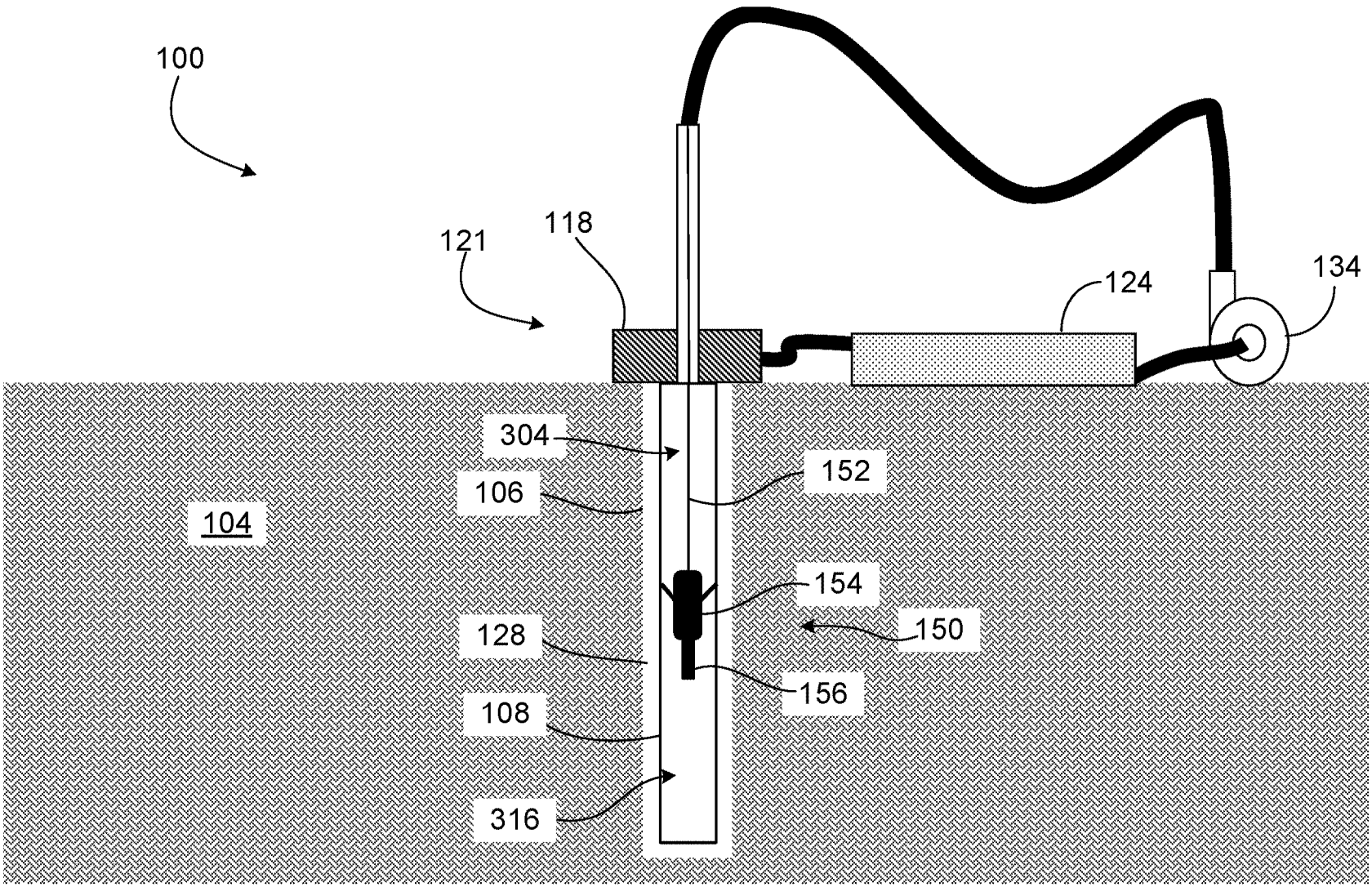
FIG. 1 is a schematic diagram of an example well system.

FIG. 1 is a schematic diagram of an example well system 100 . The well system 100 includes a wellbore 106 formed in a geologic formation 104 . Within the wellbore is a tubular 108. The tubular can be a string of production tubing, a liner, casing, or any other type of downhole tubular. An outer surface of the tubular 108 and an inner surface of the wellbore 106 define an annulus 128. At an uphole end of the wellbore is a topside facility 121 that includes a wellhead 118, a circulation pump 134 and a circulation tank 124 that holds circulation fluid. The wellhead 118 includes several valves and conduits to direct circulation fluid as desired by an operator. The wellhead is used generally within this disclosure, and can include a tree, blow out preventer (BOP), lubricator, wireline unit, or any other wellstack component needed for the operations described herein.

As illustrated, a downhole assembly 150 is within the wellbore tubular 108 supported by a wireline 152. The downhole assembly 150 includes a pump-down adapter 154 and a wellbore tool 156 to be installed or retrieved from the wellbore tubular 108. The pump-down adapter 154 engages with an inner surface of the tubular 108 to at least partially seal (that is, fully seal, or at least provide a pressure drop to reduce the flow around the pump-down adapter) and isolate an uphole portion 304 of the tubular 108 from a downhole portion 316 of a tubular. In operation, circulation fluid is circulated down the tubular 108 and up the annulus 128. That is, fluid within the uphole portion 304 of the tubular 108 displaces the pump-adapter 154 and the fluid in the downhole portion 316 of the tubular 108. This circulation sends the downhole assembly 150 in a downhole direction through the tubular 108. To stop the downhole assembly 150 from traversing through the tubular 108, the fluid circulation is ceased. To retrieve at least the pump-down adapter 154, circulation can be reversed, that is circulation fluid is flowed down the annulus 128 and up the tubular 108. Alternatively or in addition, the pump-down adapter 154 can be retrieved by retracting the wireline. Further details on the pump-down adapter 154 and operations surrounding its use are described later in the specification.

Figure 2B:
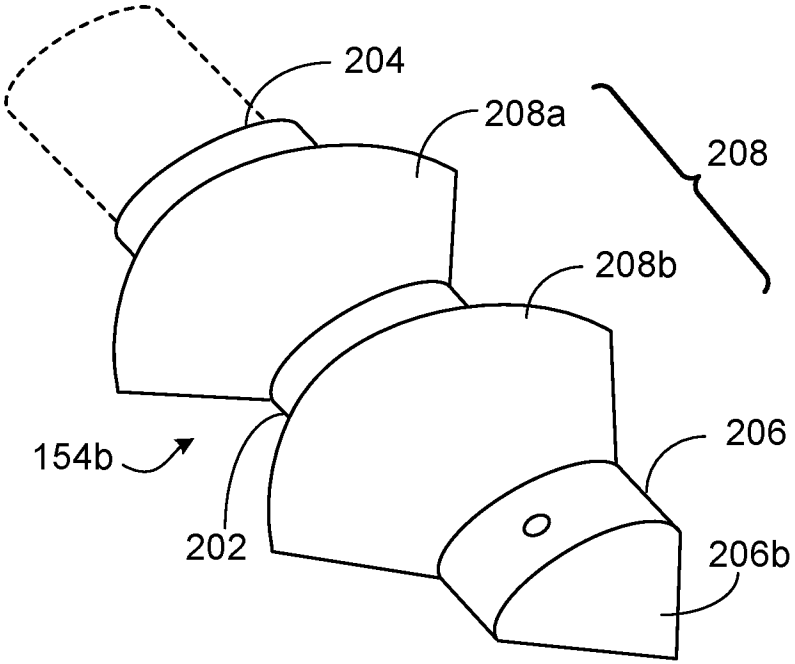
FIGS. 2A-2B are perspective schematic diagrams of example pump-down adapters.
Figure 2A:
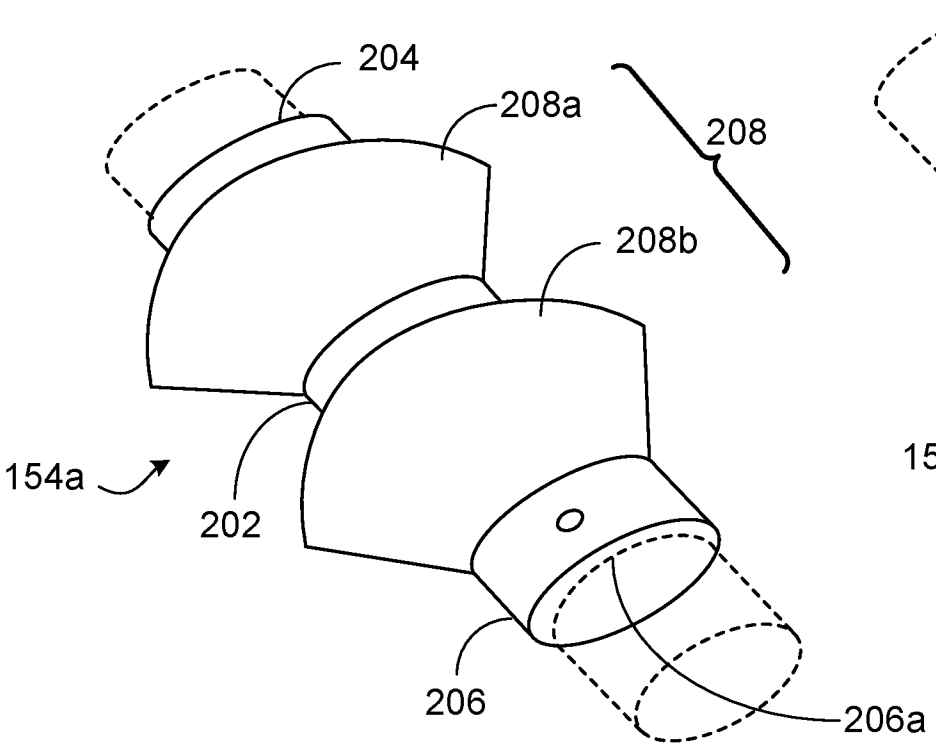

FIGS. 2A-2B are perspective schematic diagrams of example pump-down adapters 154*a* and 154*b*. In general, the pump-down adapters include a central body 202. The central body is illustrated as being a cylinder, but other shapes can be used without departing from this disclosure. In general, larger downhole-type tools utilize larger pump-down adapters. For example, the outer diameter of the central body 202 is similar to the outside diameter of the desired downhole-type tool. In some implementations, the outer diameter of the central body 202 can be slightly larger than an outside diameter of the desired downhole-type tool. The central body is typically made of metal, but can be made using any material with sufficient strength and corrosion resistance for the desired application. An uphole end 204 of the central body 202 includes a wireline attachment. Any standard wireline or slick line attachment can be used. A downhole end 206 of the central body is configured to interchangeably receive one of many downhole-type tools. For example, as illustrated by FIG. 2B, the downhole end 206 can include threads 206*b* configured to engage with any of the interchangeable downhole-type tools. In some implementations, the threaded pump-down adapter is configured to remain in the tubular with the downhole-type tool until operations are completed. In such an implementation, no sheering is used to separate the pump-down adapter from the downhole-type tool.

Alternatively or in addition, as illustrated by FIG. 2A, the downhole end includes a cavity 206*a* defined by an outer surface of the pump-down adapter 154*a*. The cavity is sized such that it can receive, or slip over, a downhole-type tool. In some implementations, the slip-over style pump-down adapter can be installed around the tool or around the running tool. The pump-down adapter can remain attach to the tool if the tool is set and left in the well (e.g. plug or pressure gauges). In some implementations, the pump-down adaptor can be retrieved after deploying the downhole-type tool.

The pump-down adapter 154 also includes one or more fins making a fin set 208*a* extending radially from an outer surface of the central body. The one or more fins 208*a* are configured to engage with an inner wall of a downhole tubular 108 (FIG. 1). For example, the fins can be made of a flexible material, such as a chemically resistant elastomer. In such an implementation, a radius of the fins 208 is slightly greater than an inner diameter of the tubular 108. The fins 208 can then deform to provide sealing against the inner wall of the downhole tubular 108. In some implementations, the radii of the fin set 208 can be slightly less than an inner diameter of the downhole tubular 108. In such a configuration, there is slight flow by across the fin set 208, but the clearance is small enough that there is sufficient pressure drop to move the pump-down adapter 154 through the tubular 108. In such an implementation, friction losses can be less than if the fins 208 are engaged with the inner surface of the downhole tubular 108, but the efficiency of sealing across the fins 208 is lessened.

In some implementations, the pump-down adapter 154 can include a first fin set 208*a* and a second a second fin set 208*b*. The second fin set 208*b* is similar to the first fin set 208*a* that has been previously described. The second fin set 208*b* includes one or more rubber fins 208 extending radially from the outer surface of the pump-down adapter 154. The second fin set is configured to engage with an inner wall of a downhole tubular. The second fin set 208*b* is axially offset from the first fin set 208*a*. That is, the first fin set 208*a* and the second fin set 208*b* share a common central axis and extend radially out from the outer surface of the pump-down adapter. In some implementations, the first fin set 208*a* and the second fin set 208*b* can extend radially out from the outer surface of the pump-down adapter 154 along two distinct, parallel planes. Including multiple fin sets with an axial offset helps increase the integrity of the seal formed across the pump-down adapter 154. While this disclosure primarily describes two fin sets on the pump-down adapter, greater or fewer fin sets can be used. For example, a pump-down adapter with a single fin set or three fin sets can be used. Design factors that are considered for the number of fin sets used include the tubular radius, the desired pressure differential across the pump-down adapter, and other criteria. In general, more fin sets increase sealing ability to a point, and therefor motive force as pressure increases.

Figure 3C:
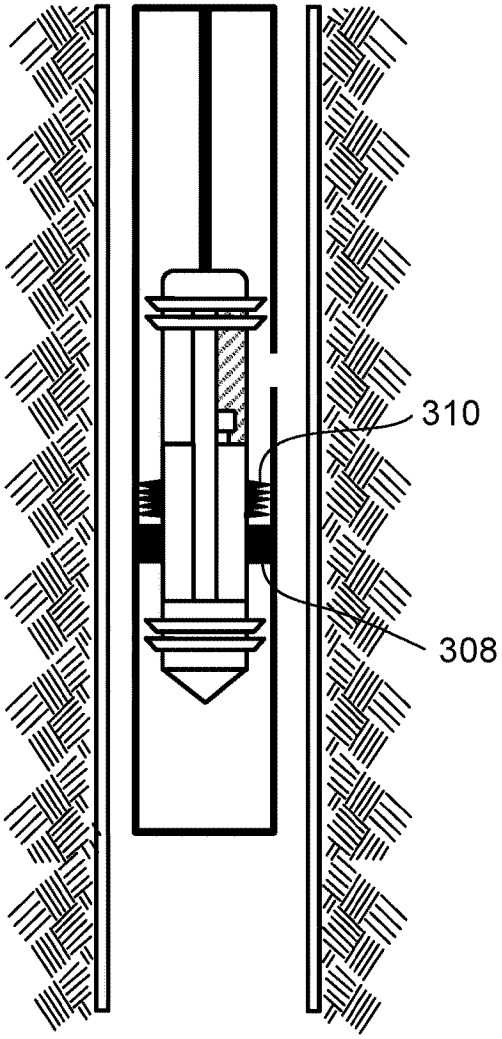
FIGS. 3A-3F are schematic diagrams of a wellbore tool being installed, used, and retrieved.
Figure 3B:
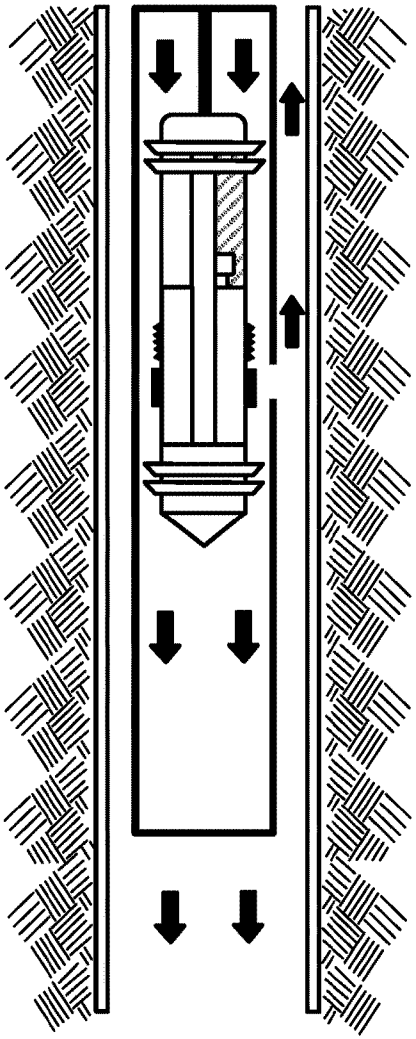
Figure 3A:
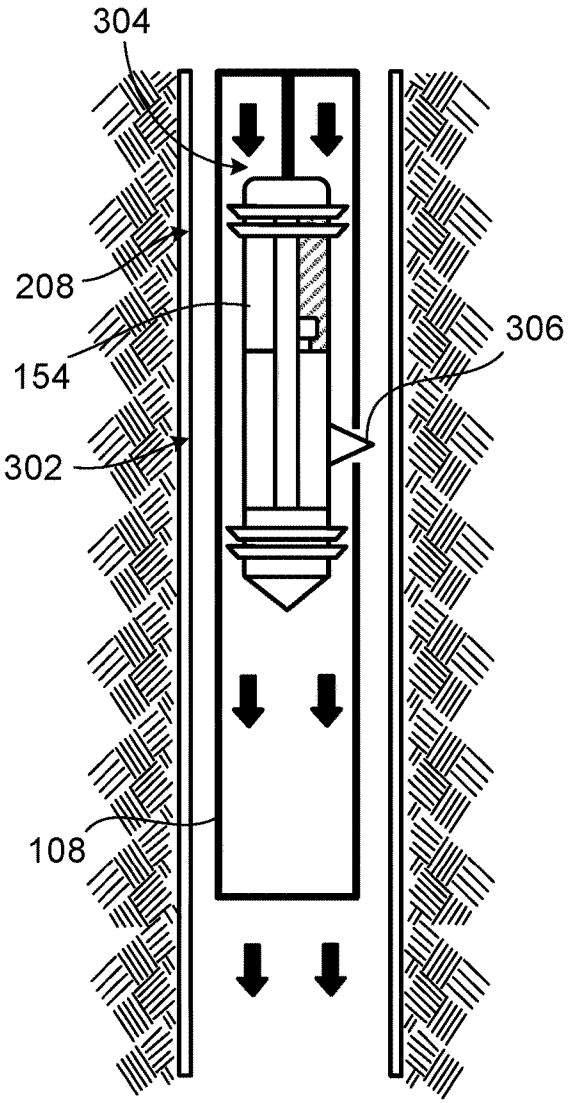

FIGS. 3A-3F are schematic diagrams of a wellbore tool being installed, used, and retrieved. As shown in FIG. 3A, an interchangeable downhole-type tool, a tubular puncher 302 in this case, is attached to the pump-down adapter 154. The one or more fins 208 extending radially from an outer surface of the pump-down adapter seal a first portion of the tubular 108 uphole of the one or more fins, and a second portion of the tubular 108 downhole of the one or more fins. Such a seal produces a pressure differential that moves the pump-down adapter 154 and tubular punch 302 through the tubular. The tubular punch 302 and the pump-down adapter 154 are positioned at a desired location within a wellbore tubular. While illustrated primarily at an uphole end of the tool, the threaded or slip-over style pump-down adaptors can be designed to be positioned ahead, across or behind the downhole-type tool based on the tools function and running/retrieving mechanism. The tubular puncher 302 and the pump-down adapter 154 are positioned by pumping fluid into the first portion 304 of the tubular. The pumped fluid increases a pressure in the first portion of the tubular and moves the tubular puncher 302 and the pump-down adapter 154 in a downhole direction. Once the tubular puncher 302 and the pump-down adapter 154 have reached the desired location, pumping is ceased and the tubular puncher 302 punches a hole 306 within the tubular.

As illustrated in FIG. 3B, the tubular puncher 302 and the pump-down adapter 154 are moved to a second position. In this case, the tubular puncher 302 is positioned downhole of the hole 306 previously formed. The tubular puncher 302 is then seated against an inner surface of the tubular, as shown in FIG. 3C. The seating mechanism can include a packer 308, a hanger 310, or both. While illustrated as being integrated into the tubular puncher 302, the packer 308 and hanger 310 can be separate modules as well. In some implementations, the packer 308 and hanger 310 can be integrated into a single module. In some implementations, tool activation can be with a timer powered by battery packs.

Figure 3F:
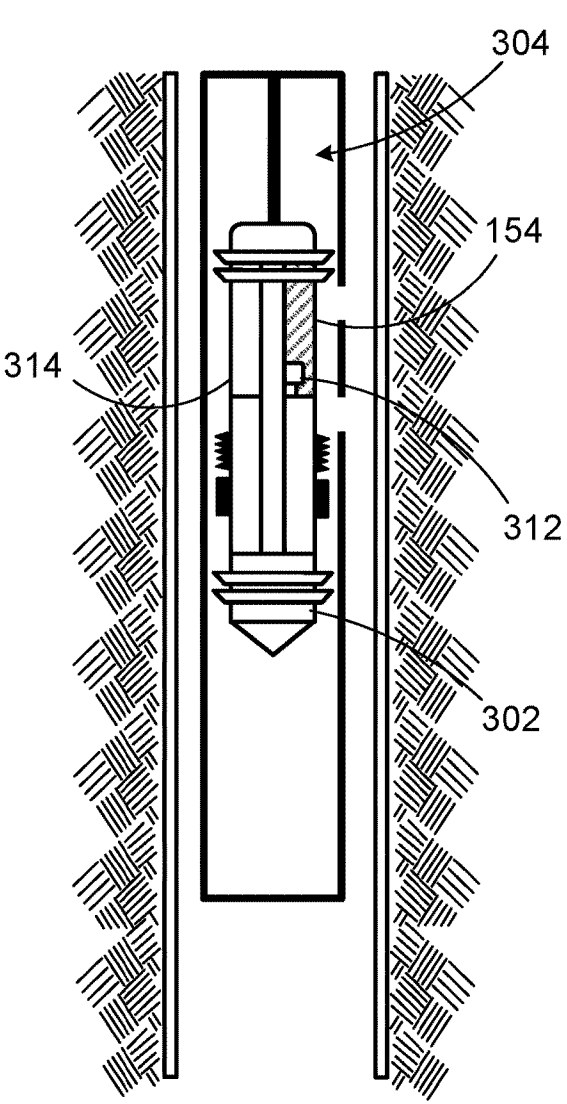
Figure 3E:
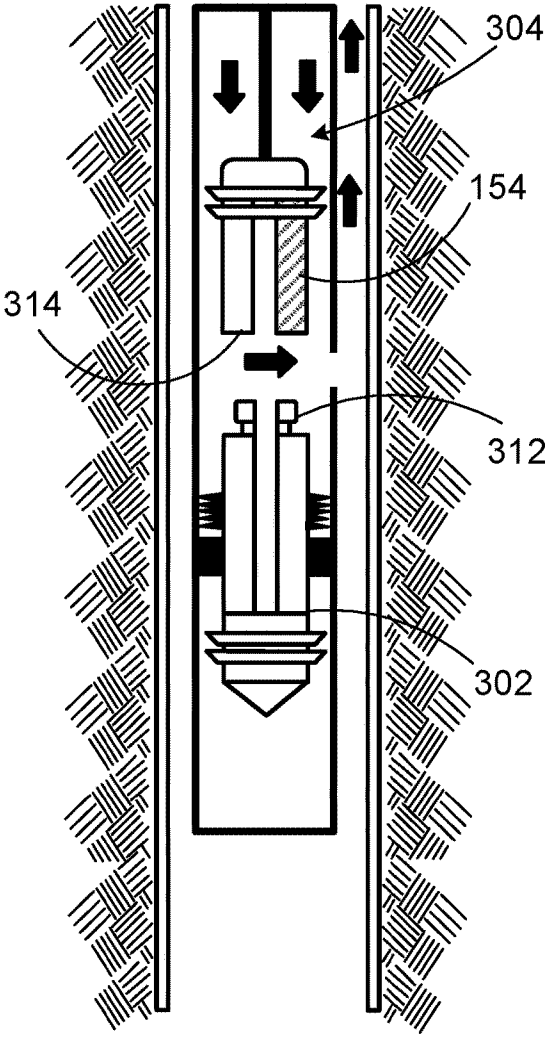
Figure 3D:
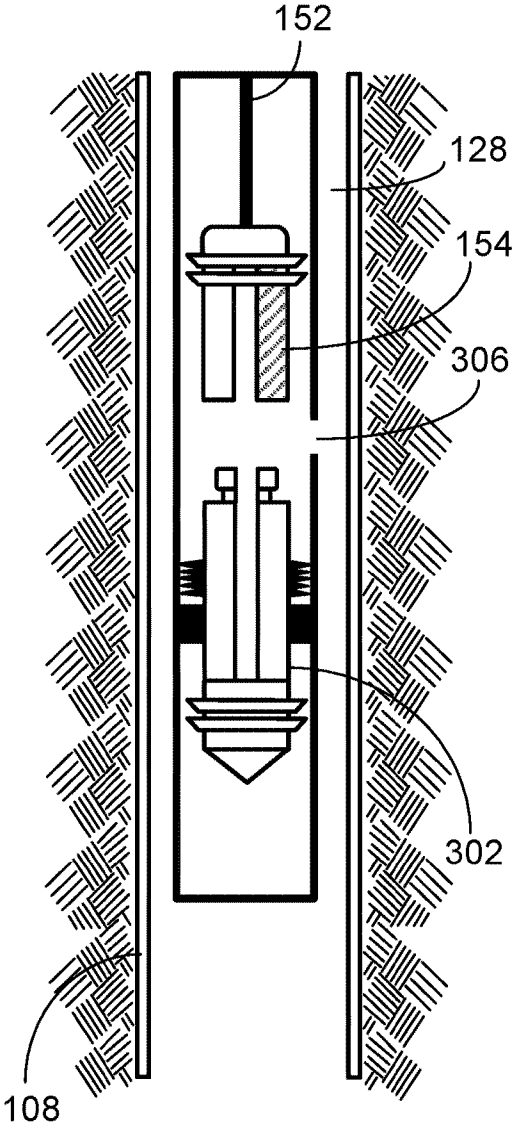

As illustrated in FIG. 3D, the pump-down adapter 154 can be separated from the tubular punch 302. The pump-down adapter can then be returned to the topside facility by retracting the wireline 152, reversing circulation through the tubular, or a combination of both. Reverse circulation involves pumping fluid into the annulus 128 and up the wellbore tubular 108. In the illustrated scenario, circulation fluid can be pumped down the annulus, through the hole 306 previously formed by the tubular puncher 302, and up the tubular 108. The pumped fluid increases a pressure in the downhole portion of the tubular, and at least partially pushes the pump-down adapter in an uphole direction. The tubular puncher 302 can remain in the wellbore for as long as desired.

After separating the downhole-type tool, as illustrated by FIGS. 3E-3F, the pump-down adapter 154 can be sent downhole into the tubular to retrieve the punching tool 302. The pump-down adapter is positioned by pumping fluid into the first portion 304 of the tubular. The pumped fluid increases a pressure in the first portion 304 of the tubular and moves the pump-down adapter 154 in a downhole direction toward the tubular puncher 302. Once the pump-down adapter 154 has reached the tubular puncher 302, the pump-down adapter 154 attaches to the tubular puncher 302. As illustrated, the tubular puncher 302 includes a fishing neck 312. The pump-down adapter includes a fishing tool 314 configured to receive the fishing neck 312. Attaching the tubular puncher 302 to the pump-down adapter includes securing the fishing tool to the fishing neck 312. In some implementations, standard slick line fishing tools can be included in the pump-down adapter 154. Such tools can be used to engage and retrieve the deployed downhole-type tool via standard fishing neck at an uphole end of the downhole-type tool.

Once the fishing tool 314 is secured to the fishing neck 312, the seating mechanism (such as the packer 308, the hanger 310, or both) can be released by an over pull of the wireline 152. Once the tubular puncher 302 is unseated, the pump-down adapter 154 and the tubular puncher 302 can be removed from the wellbore by retracting the wireline, reversing circulation, or a combination of the two.

Figure 4:
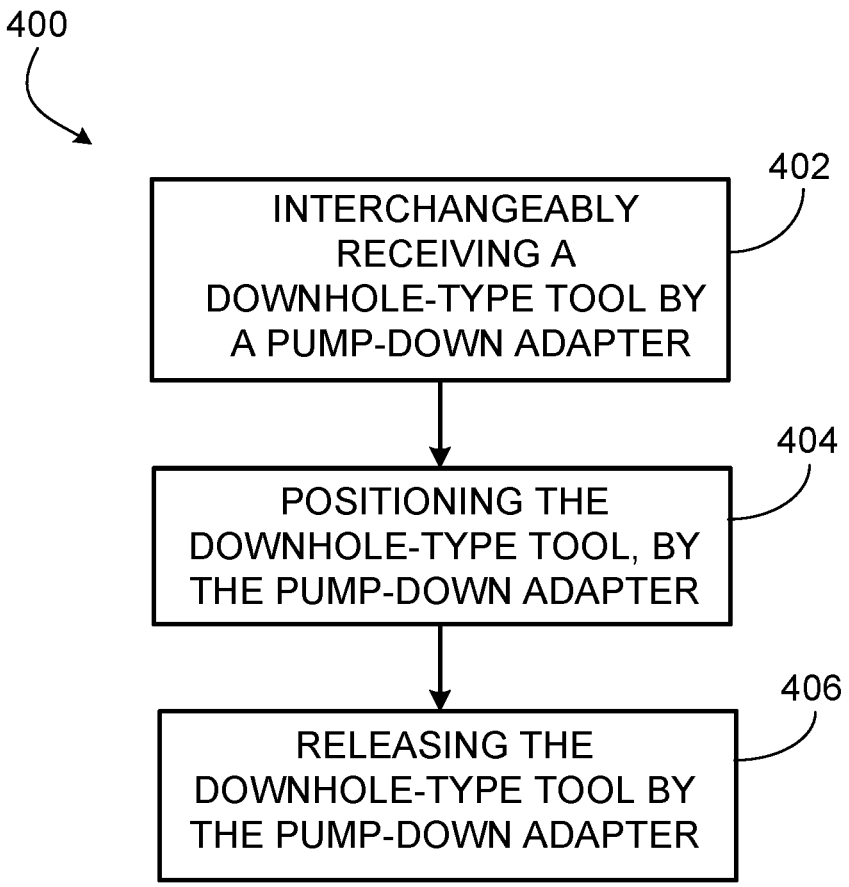
FIG. 4 is a flow chart of an example method that can be used with aspects of this disclosure.

FIG. 4 is a flow chart of an example method 400 that can be used with aspects of this disclosure. At 402, a downhole-type tool of a plurality of interchangeable downhole-type tools is interchangeably received by a pump-down adapter.

At 404, positioning the downhole-type tool, by the pump-down adapter, within a wellbore tubular. Positioning the downhole-type tool includes pumping fluid into the first portion of the tubular. The pumped fluid increases a pressure in the first portion of the tubular. The increased pressure in the first portion of the tubular moves the pump-down adapter in a downhole direction. The pressure differential across the pump-down tool is maintained by sealing a first portion of the tubular uphole of the pump-down adapter, and a second portion of the tubular downhole of the pump-down adapter. The seal is provided by one or more fins extending radially from an outer surface of the pump-down adapter.

In some implementations, after the pump-down adapter and downhole-type tool have reached the desired position, the downhole-type tool is seated within the wellbore tubular. For example, the downhole-type tool can be seated prior to releasing the downhole-type tool by the pump-down adapter. Such an implementation can include extending a packer or hanger from a radial surface of the downhole-type tool by a battery powered extension system within the downhole-type tool.

At 406, the downhole-type tool is released by the pump-down adapter. In some implementations, releasing the downhole-type tool involves over-pulling the pump-down adapter by a wireline and shearing a shear pin. The shear pin attaches the pump-down adapter and the downhole-type tool prior to the over-pull.

In some implementations, after releasing the downhole-type tool, the downhole-type tool is again received by the pump-down adapter. In such an instance, the pump-down adapter can be used to help remove the downhole-type tool from the wellbore. For example, fluid can be pumped into an annulus and up a wellbore tubular. The pumped fluid increases a pressure in the second portion of the tubular. The pressure in the second portion of the tubular, retracting the wireline attached to the pump-down adapter, or a combination of the two, can be used to remove the downhole-tool from the wellbore.

In some implementations, after the downhole-type tool is removed from the wellbore, a second downhole-type tool of the plurality of interchangeable downhole-type tools can be received by the pump-down adapter. The second downhole-type tool is then positioned within a wellbore tubular by the pump-down adapter with similar methods as described with the previous downhole-type tool. While described as removing the initial downhole-type tool prior to inserting the second downhole-type tool, some operations may involve sending multiple downhole-type tools downhole in multiple trips.

While this disclosure contains many specific implementation details, these should not be construed as limitations on the scope of any inventions or of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may have been described previously as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations previously described should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method comprising:

interchangeably receiving a downhole tool of a plurality of interchangeable downhole tools by a pump-down adapter;

positioning the downhole tool, by the pump-down adapter, within a wellbore tubular;

releasing the downhole tool by the pump-down adapter;

receiving the downhole tool by the pump-down adapter; and removing the downhole tool from a wellbore;

wherein removing the downhole tool comprises pumping fluid into an annulus and up the wellbore tubular, the pumped fluid increasing a pressure in a second portion of the wellbore tubular.

2. The method of claim 1, further comprising seating the downhole tool within the wellbore tubular.

3. The method of claim 2, wherein the downhole tool is seated prior to releasing the downhole tool by the pump-down adapter.

4. The method of claim 2, wherein seating the downhole tool comprises extending a packer or hanger from a radial surface of the downhole tool by a battery powered extension system within the downhole tool.

5. The method of claim 1, further comprising:

sealing, by one or more fins extending radially from an outer surface of the pump-down adapter, a first portion of the tubular uphole of the one or more fins, and the second portion of the tubular downhole of the one or more fins.

6. The method of claim 5, wherein positioning the downhole tool comprises:

pumping fluid into the first portion of the tubular, the pumped fluid increasing a pressure in the first portion of the tubular, the increased pressure in the first portion of the tubular moves the pump-down adapter.

7. The method of claim 1, wherein releasing the downhole tool comprises:

over pulling the pump-down adapter by a wireline; and shearing a shear pin in response to the over pulling, the shear pin attaching the pump-down adapter and the downhole tool.

8. The method of claim 1 further comprising:

removing the pump-down adapter from the wellbore;

receiving a second downhole tool of the plurality of interchangeable downhole tools by the pump-down adapter; and positioning the second downhole tool, by the pump-down adapter, within a wellbore tubular.

9. A method comprising:

attaching an interchangeable downhole tool of a plurality of interchangeable downhole tools to a pump-down adapter;

sealing, by one or more fins extending radially from an outer surface of the pump-down adapter, a first portion of the tubular uphole of the one or more fins, and a second portion of the tubular downhole of the one or more fins;

positioning the downhole tool and the pump-down adapter within a wellbore tubular;

separating the downhole tool from the pump-down adapter;

attaching the downhole tool to the pump-down adapter; and removing the downhole tool and the pump-down adapter from a wellbore;

wherein removing the downhole tool comprises pumping fluid into an annulus and up the wellbore tubular, the pumped fluid increasing a pressure in the second portion of the tubular.

10. The method of claim 9, wherein positioning the downhole tool and the pump-down adapter comprises:

pumping fluid into the first portion of the tubular, the pumped fluid increasing the pressure in the first portion of the tubular.

11. The method of claim 9, wherein the downhole tool further comprises a fishing neck, and the pump-down adapter comprises a fishing tool configured to receive the fishing neck, wherein attaching the downhole tool to the pump-down adapter comprises securing the fishing tool to the fishing neck.

12. The method of claim 9, wherein the downhole tool is a tubular puncher, the method further comprising forming a hole in a tubular wall by the tubular puncher.

* * * * *